7/25/78 XR 4,103,103

United States Patent [19]

Hizikata

[11] 4,103,103

[45] Jul. 25, 1978

[54] ELECTRICAL INSULATORS HAVING SEMI-CONDUCTING GLAZE AND CONDUCTIVE PORTLAND CEMENT CONTAINING A SPECIFIED AMOUNT OF CARBON BLACK

[75] Inventor: Tosihiko Hizikata, Nagoya, Japan

[73] Assignee: NGK Insulators, Ltd., Nagoya, Japan

[21] Appl. No.: 733,171

[22] Filed: Oct. 18, 1976

[30] Foreign Application Priority Data

Aug. 10, 1976 [JP] Japan ..... 51/94548

[51] Int. Cl.[2] ..... H01B 17/42; H01B 17/50

[52] U.S. Cl. ..... 174/140 C; 106/97; 106/98; 174/182; 174/211; 252/502

[58] Field of Search ..... 174/137 B, 138 C, 140 C, 174/141 C, 182, 189, 196, 211; 106/97, 98; 252/502, 509

[56] References Cited

U.S. PATENT DOCUMENTS

| | | | |
|---|---|---|---|
| 3,166,518 | 1/1965 | Barnard | 106/97 X |
| 3,836,705 | 9/1974 | Rosenblatt | 174/140 C |
| 3,941,918 | 3/1976 | Nigol et al. | 174/140 C |

FOREIGN PATENT DOCUMENTS

| | | | |
|---|---|---|---|
| 1,363,428 | 8/1974 | United Kingdom | 106/97 |

*Primary Examiner*—Laramie E. Askin

*Attorney, Agent, or Firm*—Stevens, Davis, Miller & Mosher

[57] ABSTRACT

An electrical insulator having a semi-conducting glaze, in which the region between an insulating body whose surface is coated with a semi-conducting glaze, and metal fittings, is filled with a conductive cement composition. The conductive cement composition contains 0.75–3.0 parts by weight of carbon black per each 100 parts by weight of Portland cement and has a high mechanical strength and a low volume resistivity.

6 Claims, 6 Drawing Figures

ELECTRICAL INSULATORS HAVING SEMI-CONDUCTING GLAZE AND CONDUCTIVE PORTLAND CEMENT CONTAINING A SPECIFIED AMOUNT OF CARBON BLACK

BACKGROUND OF THE INVENTION

1. Field of the Invention

The present invention relates to electrical insulators having semi-conducting glaze, and more particularly relates to an electrical insulator having a semi-conducting glaze, which comprises an insulating body with its surface coated with a semi-conducting glaze, metal fittings and a cement composition filled between the insulating body and the metal fittings.

2. Description of the Prior Art

Electrical insulators having semi-conducting glaze have a unique pollution resistance and have recently been adopted in power transmission lines. In the electrical insulators, a semi-conducting glaze layer formed on the surface of an insulating body must be electrically connected to metal fittings to cause very weak electric current to flow through the semi-conducting glaze layer. Various connecting methods have hitherto been proposed for this purpose. In a typical connecting method, a metal is hot sprayed on the glaze, cement and metal fittings to form metal film layers thereon and to form electric current paths. However, this method has drawbacks, in cost, mass productivity, liability and the like. In another typical connecting method, conductive cement is filled between an insulating body and metal fittings. However, conventional conductive cement has a low mechanical strength, so that this method has the drawback that an electrical insulator as a whole must be large in size. Therefore, the development of new conductive cement having a high mechanical strength has been eagerly desired. The electrical conductivity of conventional conductive cement compositions is given by conductive materials, such as carbon black, graphite, carbon fiber and the like, mixed with cement. Among these conductive materials, graphite itself has an electric resistance of about 1/10 - 1/100 times lower than that of carbon black, but a cement composition having a desired electric conductivity cannot be obtained unless a large amount of graphite is added to cement, and therefore the mechanical strength of the resulting cement composition is decreased due to the presence of a large amount of graphite in the cement composition. Although carbon fiber itself has an electric resistance of about 1/10 - 1/100 times lower than that of carbon black, when carbon fiber is mixed with cement, the resulting cement composition is low in the mechanical strength, is poor in workability due to its very low fluidity during use, and is remarkably uneven in the electric resistance. Moreover, when the cement composition is used under a high current density, the electric circuit is thermally broken and the cement composition is apt to lose its electric conductivity. In order to obviate these drawbacks, conductive cement compositions to be used in electrical insulators, which require a high strength, have been proposed, for example, in U.S. Pats. Nos. 3,836,705 and 3,941,918 and in British Pat. No. 1,398,306. In the above described U.S. Pat. No. 3,941,918, a conductive cement composition obtained by mixing Portland cement with carbon black is used. However, the U.S. Patent discloses that the use of carbon black alone is insufficient for giving a satisfactorily high mechanical strength to cement, and 0.5–2.0 parts by weight of graphite fiber is further added to the cement composition to obtain a cement composition having a desired mechanical strength required in electrical insulators. However, the resulting cement composition has a compression strength of at most about 633–703 $Kg/cm^2$, and moreover the cement composition is remarkably uneven in the electric resistance due to the presence of the graphite fiber and is very poor in the workability. In the "Electrically conductive cement" disclosed in the above described British Pat. No. 1,398,306, sulfur cement is mixed with fine graphite. However, the resulting conductive cement also has a low mechanical strength, and therefore the cement can be applied to a column-shaped insulator, particularly the so-called multi-cone type insulator, which does not require so high mechanical strength. However, when the cement is used in a disk-shaped suspension insulator or the like, which requires a high mechanical strength, the electrical insulator must be designed into a particular shape in order to compensate for the reduction in the mechanical strength of the cement and as a result it is obliged to provide a large size electrical insulator as a whole.

As described above, it has hitherto been a general recognition in the technical field of the present invention that carbon black cannot be used alone in order to give adequate electric conductivity to a cement composition to be filled between the insulating body of an electrical insulator and the metal fittings thereof. One of the reasons of such recognition by those skilled in the art is as follows. Carbon black is finely granular and porous and has a large specific surface area. Therefore, in order to obtain a cement composition containing carbon black and further having high fluidity and workability, the water-cement ratio must be fairly high. However, when the water-cement ratio is high, the mechanical strength of the cement composition is considerably decreased and the shrinkage thereof becomes high. Therefore, the cement composition loses performances necessary for fillings between the insulating body and the metal fittings in an electrical insulator.

The inventor has investigated the parameters, which influence the electric conductivity of hardened cement composition containing carbon black, and succeeded to overcome the general recognition by those skilled in the art relating to the behavior and faculty of carbon black in a cement composition, thereby eliminating the above described drawbacks of conventional electrical insulators.

SUMMARY OF THE INVENTION

The object of the present invention is to provide an electrical insulator having a semi-conducting glaze, which has a high mechanical strength.

The electrical insulator having a semi-conducting glaze according to the present invention comprises an insulating body with its surface coated with a semi-conducting glaze, metal fittings and a conductive cement composition filled between said insulating body and said metal fittings, said conductive cement composition containing 0.75–3.0 parts by weight, preferably 0.75–2.5 parts by weight, more preferably 0.75–2.0 parts by weight, of carbon black, preferably acetylene black, per each 100 parts by weight of Portland cement, preferably high-early-strength Portland cement.

DETAILED DESCRIPTION OF THE INVENTION

The electrical insulator having a semi-conducting glaze according to the present invention will be explained in more detail referring to experimental data.

A relation between the bulk density of powdery carbon black, which had not yet been subjected to a secondary processing, and the volume resistivity of a hardened cement composition containing 4 parts by weight of the carbon black per each 100 parts by weight of ordinary Portland cement was examined. The bulk density was measured in the following manner. 100 cc of a sample was charged into a measuring cylinder of 100 cc capacity, and the weight of the sample was measured. Then, the measuring cylinder was closed by means of a plug and dropped 50 times on a rubber sheet from a height of about 5 cm, and the volume of the above treated sample was measured. The bulk density of the sample was calculated by the following formula.

$$\rho = W/V$$

In the above formula, $\rho$: bulk density (g/cc) of a sample

W: weight (g) of the sample

V: volume (cc) of the sample after dropped 50 times.

Figure 1:
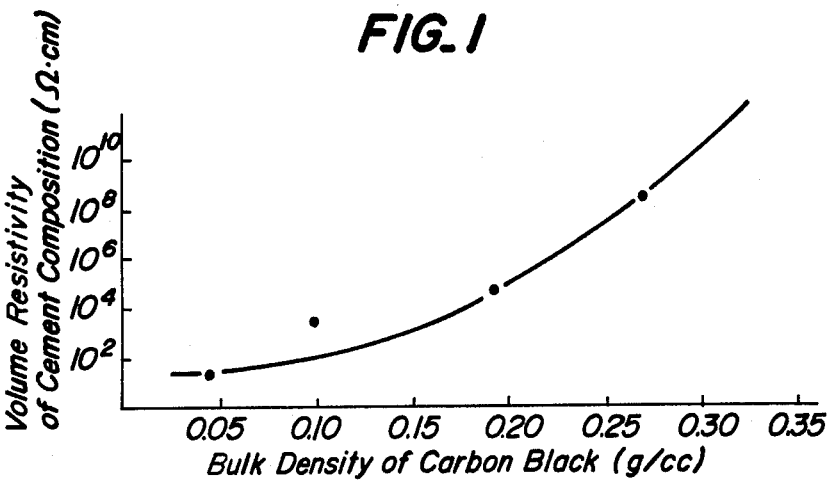
FIG. 1 is a graph showing a relation between the volume resistivity of a cement composition and the bulk density of carbon black contained in the cement composition.

The result thus obtained is shown in FIG. 1.

Figure 2:
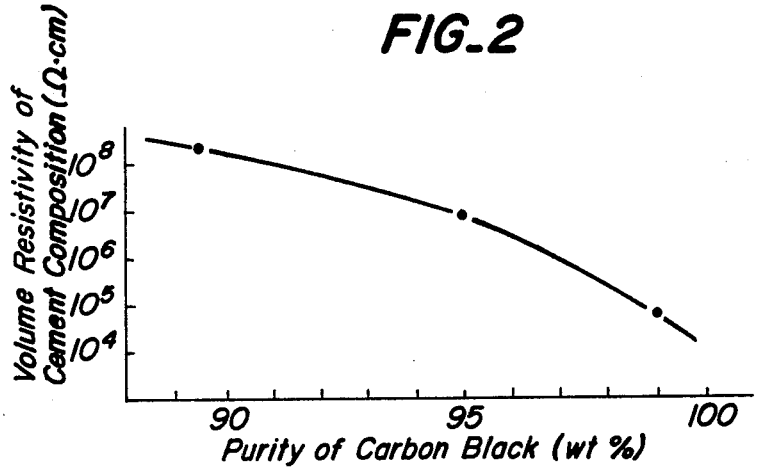
FIG. 2 is a graph showing a relation between the volume resistivity of a cement composition and the purity of carbon black contained in the cement composition.

A relation between the volume resistivity of a hardened cement composition containing 4 parts by weight of carbon black per each 100 parts by weight of ordinary Portland cement and the purity of the carbon black was examined. FIG. 2 shows the result.

Figure 3:
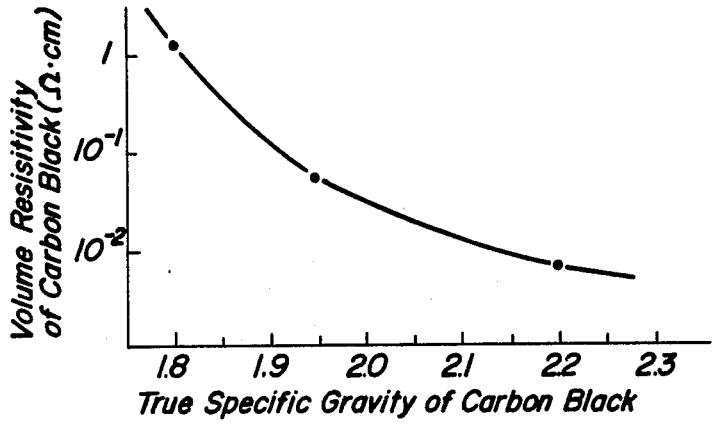
FIG. 3 is a graph showing a relation between the true specific gravity of carbon black and the volume resistivity of the carbon black itself.

A relation between the true specific gravity of carbon black, i.e., the graphitization degree of carbon black, and the volume resistivity of the carbon black itself was examined. FIG. 3 shows the result. The volume resistivity of carbon black itself was measured with respect to a sample prepared by compressing the carbon black into a height of 10±0.5 mm under a pressure of 50 Kg/cm$^2$.

It can be seen from FIGS. 1-3 that the volume resistivity of hardened conductive cement is influenced by the 3 parameters bulk density, purity and true specific gravity of carbon black. That is, the transfer of electric current through hardened conductive cement is electron transfer due to contact of carbon black. Therefore, it is considered that carbon black having a lower electric resistance and further having a larger apparent volume when the carbon black is dispersed in cement to form a bridge therein, i.e., having a lower bulk density, leads to a good result. When a very small amount of such carbon black having a low bulk density, a high purity and a high true specific gravity, preferably acetylene black, is mixed with cement, a hardened cement having a predetermined electric conductivity can be obtained, and the hardened cement has the same mechanical strength as that of a hardened non-conductive Portland cement composition, which is ordinarily used for filling between the insulating body and metal fittings of an electrical insulator. Therefore, electrical insulators having semi-conducting glaze can be produced under the same strength design as that for ordinary electrical insulators.

Figure 4:
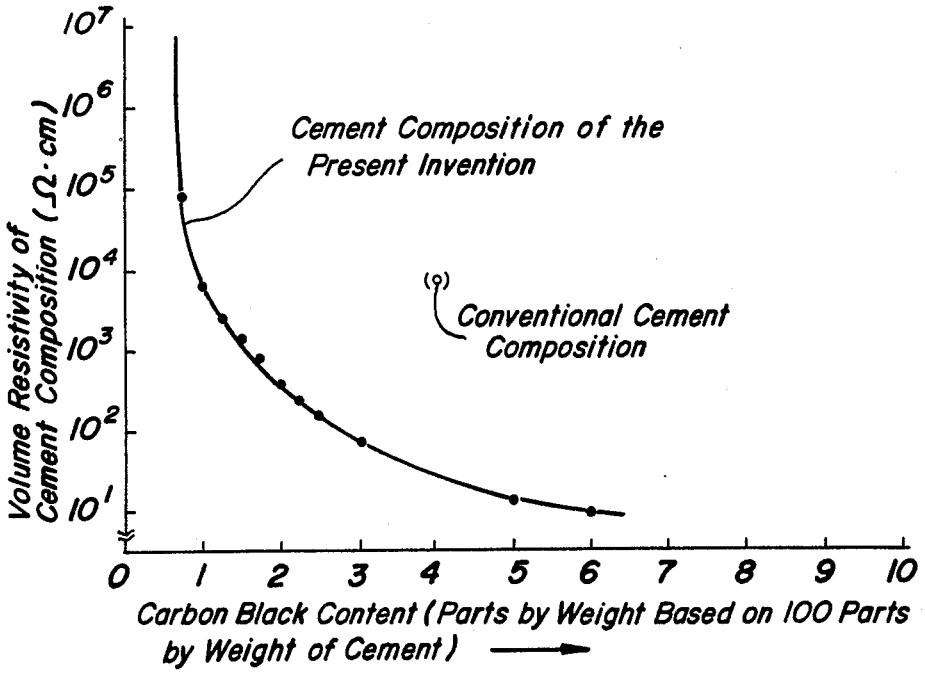
FIG. 4 is a graph showing a relation between the carbon black content in the cement composition according to the present invention and the volume resistivity of the cement composition.

Further, a variant amount of acetylene black made by Electro Chemical Industrial Co., Ltd., Tokyo, as a carbon black was added to 100 parts by weight of ordinary Portland cement to prepare a cement composition containing no sand, and a relation between the volume resistivity of the cement composition and the carbon content therein was examined. FIG. 4 shows the result. In FIG. 4, for comparison, the surface resistivity of a conventional cement composition disclosed in the above described U.S. Pat. No. 3,941,918, which consists of 100 parts by weight of ordinary Portland cement and 4 parts by weight of Vulcan XC-72 (carbon black made by Cabot Carbon Ltd. in U.S.A.) and contains no sand, is described together. It can be seen from FIG. 4 that, when 4 parts by weight of carbon black is mixed with 100 parts by weight of cement, conventional cement composition has a volume resistivity of $6.9\times10^3$ Ω.cm, while the cement composition of the present invention has a volume resistivity of only 31 Ω.cm. Further, it can be seen from FIG. 4 that the cement composition containing only 1.0 part by weight, based on 100 parts by weight of cement, of acetylene black according to the present invention has the same surface resistivity as that of a conventional cement composition containing 4.0 parts by weight, based on 100 parts by weight of cement, of carbon black, Vulcan XC-72.

Figure 5:
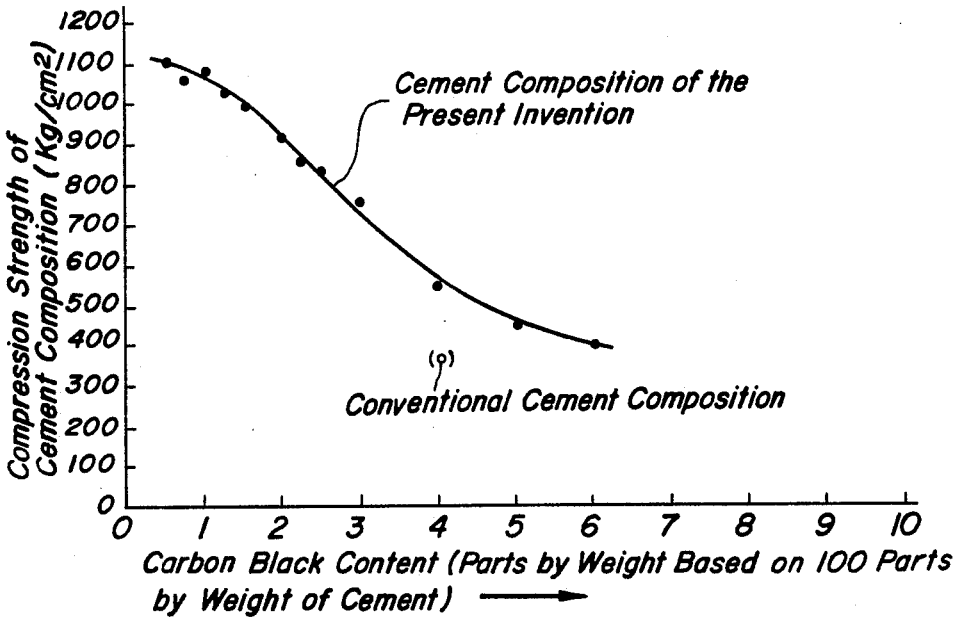
FIG. 5 is a graph showing a relation between the carbon black content in the cement composition according to the present invention and the compression strength of the cement composition.

A relation between the compression strength of the same cement composition as that used in the test of FIG. 4 and the carbon black content therein was examined. FIG. 5 shows the result. In FIG. 5, for comparison, the compression strength of a conventional cement composition disclosed in the above described U.S. Pat. No. 3,941,918 is described together. As seen from FIG. 5, when the carbon black content is 4 parts by weight, the conventional cement composition has a compression strength of 356 Kg/cm$^2$, while the cement composition of the present invention has a compression strength of 555 Kg/cm$^2$. Moreover, the cement composition of the present invention containing 1.0 part by weight of acetylene black has a compression strength of 1,080 Kg/cm$^2$, which is 3 times higher than that of the conventional cement composition containing 4 parts by weight of Vulcan XC-72.

The cement compositions used in the above described experiments are ones cured for 24 hours with steam kept at 45° C. As the sample in the test of compression strength, use is made of a cubic body having an edge length of 40 mm.

In an electrical insulator having a semi-conducting glaze, it is necessary that a conductive cement composition to be filled between an insulating body with its surface coated with a semi-conducting glaze and metal fittings should have a volume resistivity of not higher than $10^5$ Ω.cm in view of the electric resistance of the semi-conducting glaze layer, the density of electric current passing through the conductive cement composition and the resistance stability during the production of the electrical insulator. Therefore, the necessary minimum amount of carbon black to be added to cement is determined from the resistance value of the desired electrical insulator. The addition of a large amount of carbon black to cement decreases noticeably the mechanical strength of hardened cement composition, and therefore the maximum addition amount of carbon black is determined from the mechanical strength of hardened cement composition. Cement composition for electrical insulator must have a mechanical strength of a compression strength of at least 750 Kg/cm$^2$. Based on the above described reasons, the amount of carbon black to be contained in a conductive cement composition for electrical insulators having semi-conducting glaze is limited within a certain range, and it is clear from FIGS. 4 and 5 that the amount of carbon black to be contained in the conductive cement composition is 0.75–3.0 parts by weight per each 100 parts by weight of Portland cement.

Furthermore, it is preferable that the cement composition filled between an insulating body and metal fittings of electrical insulators, particularly electrical insulators having semi-conducting glaze, be low in the shrinkage, and therefore it is desirable to mix cement with sand in an amount as large as possible yet still maintain the strength of cement necessary for electrical insulators.

Formulations of conductive cement compositions, which can be particularly preferably between an insulating body with its surface coated with a semi-conducting glaze and metal fittings of the electrical insulator according to the present invention, are as follows.

Table 1

| Formulation (parts by weight) | Cement Composition Number 1 | 2 | 3 | 4 |
|---|---|---|---|---|
| Ordinary Portland cement | 100 | — | — | — |
| High-early-strength Portland cement | — | 100 | 100 | 100 |
| Sand | 25 | 25 | 70 | 130 |
| Acetylene black | 1.50 | 1.75 | 2.00 | 2.25 |
| Water (water-cement ratio) | 33 | 37 | 41 | 45 |
| Compression strength (Kg/cm$^2$) | 910 | 920 | 840 | 750 |
| Volume resistivity (Ω·cm) | $1.5\times10^3$ | $1.3\times10^3$ | $2.1\times10^3$ | $2.9\times10^3$ |

Figure 6:
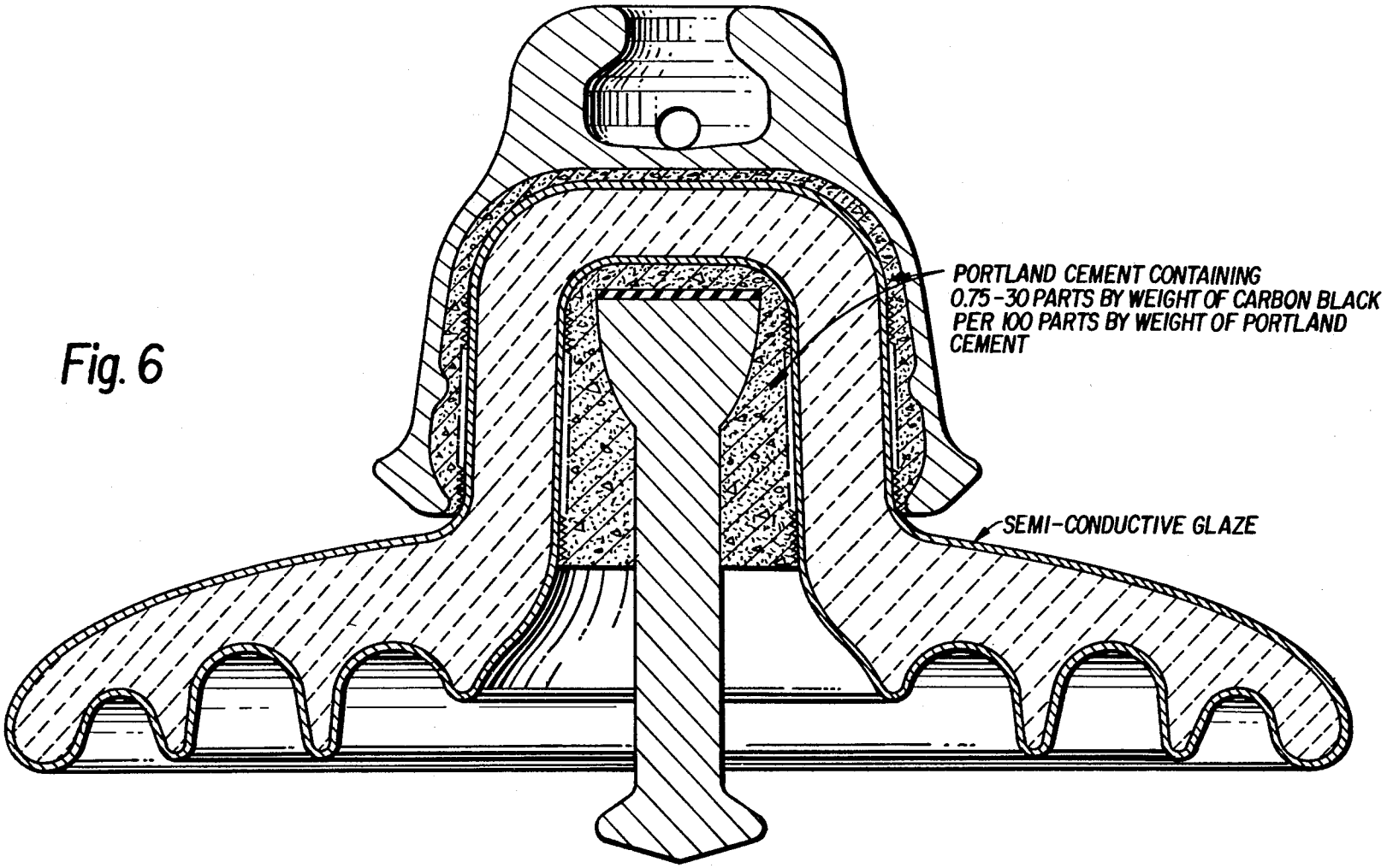
FIG. 6 is a partially schematic, cross-sectional drawing of the electrical insulator of the presently claimed invention.

FIG. 6 shows in partially schematic, cross-sectional form the electrical insulator of the present invention having a semi-conductive glaze thereon. It also shows the conductive cement composition filled in the area between the insulating body and metal fitting and in electrical contact therewith. As previously indicated, the conductive cement composition contains 0.75–30 parts by weight of carbon black per 100 parts by weight of Portland cement.

As described above minutely, in the electrical insulator having a semi-conducting glaze according to the present invention, a conductive cement composition having a sufficiently high electrical conductivity and having a mechanical strength remarkably higher than that of conventional cement composition is filled between the insulating body with its surface coated with a semi-conducting glaze and the metal fittings. Therefore, according to the present invention, electrical insulators having a satisfactorily high mechanical strength can be produced without forming into a large size or without designing into a particular shape, and the present invention contributes highly to the development of industry.

What is claimed is:

1. An electrical insulator having a semi-conducting glaze, which comprises an insulating body with its surface coated with a semi-conducting glaze, metal fittings and conductive cement composition filled between said insulating body and said metal fittings and in electrical contact with both said semi-conducting glaze and said metal fittings, said conductive cement composition containing 0.75 – 3.0 parts by weight of carbon black having bulk density, carbon purity and specific gravity which correspond to those of acetylene black per 100 parts by weight of Portland cement, the conductivity of the cement composition being substantially given by the carbon black only.

2. An electrical insulator according to claim 1, wherein said conductive cement composition contains 0.75–2.5 parts by weight of carbon black per each 100 parts by weight of Portland cement.

3. An electrical insulator according to claim 1. wherein said conductive cement composition contains 0.75–2.0 parts by weight of carbon black per each 100 parts by weight of Portland cement.

4. An electrical insulator according to claim 1, wherein said carbon black is acetylene black.

5. An electrical insulator according to claim 1, wherein said Portland cement is high-early-strength Portland cement.

6. An electrical insulator having a semi-conducting glaze, which comprises an insulating body with its surface coated with a semi-conducting glaze, metal fittings and conductive cement filled between said insulating body and said metal fittings and in electrical contact with both said semi-conducting glaze and said metal fittings, said conductive cement composition containing a conductive additive consisting essentially of 0.75 – 3.0 parts by weight of carbon black having bulk density, carbon purity and specific gravity which correspond to those of acetylene black per each 100 parts by weight of Portland cement.

* * * * *